US005092040A

United States Patent [19]

Kato et al.

[11] Patent Number: 5,092,040

[45] Date of Patent: Mar. 3, 1992

[54] SPIN MOLDING PROCESS FOR MANUFACTURING A VEHICLE WHEEL

[75] Inventors: Takashi Kato; Kimio Ochiai; Masaru Kurebayashi, all of Shizuoka, Japan

[73] Assignee: Asahi Malleable Iron Co., Ltd., Shizuoka, Japan

[21] Appl. No.: 426,953

[22] Filed: Oct. 24, 1989

[30] Foreign Application Priority Data

| | | | |
|---|---|---|---|
| Oct. 24, 1988 | [JP] | Japan | 63-268559 |
| Oct. 24, 1988 | [JP] | Japan | 63-268560 |
| Apr. 13, 1989 | [JP] | Japan | 1-93339 |
| Aug. 26, 1989 | [JP] | Japan | 1-220067 |
| Aug. 26, 1989 | [JP] | Japan | 1-220068 |
| Aug. 26, 1989 | [JP] | Japan | 1-220069 |

[51] Int. Cl.[5] ..... B21D 53/00

[52] U.S. Cl. ..... 29/894.324; 72/70

[58] Field of Search ..... 29/894.324; 72/68, 84, 72/70

[56] References Cited

U.S. PATENT DOCUMENTS

| | | | |
|---|---|---|---|
| 2,075,294 | 3/1937 | Le Jeune | 29/894.324 |
| 4,528,734 | 7/1985 | Beyer | 29/894.324 |

FOREIGN PATENT DOCUMENTS

| | | | |
|---|---|---|---|
| 115641 | 6/1986 | Japan | 29/894.324 |
| 115640 | 8/1986 | Japan | 29/894.324 |

*Primary Examiner*—P. W. Echols

*Attorney, Agent, or Firm*—Darby & Darby

[57] ABSTRACT

A process for manufacturing a vehicle wheel includes the steps of preparing a wheel raw material blank in which rim raw material is integrally formed at a peripheral edge of a disk member. The rim portion is formed by spinning the rim raw material while rotating the wheel material about the axis of the disk member. Thereafter, such spin molded raw material is heat treated, and then machined by cutting. The center portion of the rim is spin formed to its final thickness while the rim edge portions are left with a thickness after spin molding that requires machine cutting to the final dimensions.

1 Claim, 11 Drawing Sheets

SPIN MOLDING PROCESS FOR MANUFACTURING A VEHICLE WHEEL

BACKGROUND OF THE INVENTION

This invention relates to a spin molding process, a spin molding apparatus, a spin molding raw material, a spin molding process for a vehicle wheel, and a spin molding apparatus of a vehicle wheel.

As a process for manufacturing a vehicle wheel, there is a known process for applying a heat treatment after the spin molding is effected. In this manufacturing process, as the rim portion subjected to the spin molding is readily deformed by heating when a heat treatment is applied, it is necessary to take steps to prevent the air leakage of a tire. Therefore, when the spin molding is carried out, the rim portion 3, as shown in FIG. 23, is formed thicker than the final thickness (shown by the one dotted chain lines in the drawings). And after being subjected to the thermal treatment, such rim portion is cut into the final dimension.

However, the above-mentioned conventional manufacturing process for vehicle wheels has a first inconvenience in that as the thickness of the whole rim portion is formed greater than the final dimensions and the whole rim portion is cut after it is subjected to heat treatment, much time and labor are required for the cutting, and thus for the manufacturing of the vehicle wheel, and the yield of product from the material is lowered.

Also, when a vehicle wheel is spin molded in the prior art, it is performed so that raw material for a vehicle wheel is disposed on the periphery of a molding die (mandrel). The wheel raw material is drawn along the molding die by a rotary pressing device while rotating this raw material together with the molding die.

However, as the molding die (mandrel) is inherent in vehicle wheels, it is required to be exchanged with a separately prepared molding die (mandrel) when a vehicle wheel having different trim width is to be molded.

Therefore, there is a second inconvenience in that in order to spin mold a vehicle wheel, several kinds of molding dies (mandrels) must be prepared. As a consequence, the manufacturing cost of the molding dies (mandrels) is increased, and, in addition, it takes much time and labor for maintaining the molding dies (mandrels).

Also, in the prior art, when the spin molding is to be carried out, first the raw material is cast and such cast raw material is spin molded.

In this case, in the prior art, there were used, as a molding material, the so-called 4 C-material (for example, Cu: 0.006 wt.%, Mg: 0.33 wt.%, Fe: 0.12 wt.%, Mn: 0.006 wt.%, Ti: 0.115%, Sb: 0.112 wt.% and the remainder Al). By casting this molding member, a raw material is manufactured and this raw material is spin molded.

However, the conventional molding material, has a third inconvenience in that moldability is poor due to lack of expansion.

Also, in the prior art, for example, when a vehicle wheel W is to be spin molded, a disk portion D and a cylindrical rim portion 3 as shown in FIG. 24, are molded by forging or casting to obtain a wheel raw material or blank 1. And by drawing this raw material 1, which is engaged on the outer periphery of a rim molding mandrel 12, in the direction as shown by the arrow through a rotary pressing device 2, a rim portion 31 is formed (Japanese Patent Early Laid-Open Publication No. Sho 61-115640).

However, in such conventional spin molding process as mentioned above, when a cylindrical raw material blank to be molded (cylindrical rim raw material) 3 is placed on the molding mandrel (rim molding mandrel) 12, this cylindrical raw material to be molded (cylindrical rim raw material) 3 is intimately contacted with a molding surface 126 of said molding mandrel (rim molding mandrel) 12.

Due to the foregoing arrangement, when such cylindrical raw material 3 as mentioned is drawn through the rotary pressing device 2, friction is generated between the cylindrical raw material 3 and the molding surface 126 of the mandrel 12. Therefore, it has a fourth inconvenience in that it takes much time and labor to draw the cylindrical raw material 3 along the projecting portion (rim flange molding portion) of the molding surface 126.

Also, in such conventional spin molding process as mentioned, as the cylindrical raw material to be molded (cylindrical rim raw material) 3 becomes gradually thinner as it goes toward the peripheral edge portion thereof, it has a fifth inconvenience in that the thickness of a rising portion 311 is difficult to increase, when the cylindrical raw material 3 is drawn by the rotary pressing device 2 along the projecting portion (rim flange molding portion) of the molding surface 126.

Furthermore, in such conventional spin molding process as mentioned above, as the thickness of the connecting portion between the cylindrical raw material to be molded (cylindrical rim raw material) 3 and a plate portion to be clamped (disk portion) D is great, there is a sixth inconvenience in that a decaying part is readily generated on the connecting portion 315 when the raw material 1 is cast and thus, the strength of a spin molded article is difficult to maintain.

Furthermore, in such conventional spin molding process as mentioned above, when the cylindrical raw material to be molded (cylindrical rim raw material) 3 is placed on the molding mandrel (rim molding mandrel) 12, this cylindrical raw material to be molded (cylindrical rim raw material) 3 is intimately contacted to the molding surface 126 of the molding mandrel (rim molding mandrel) 12.

Due to the foregoing, friction is generated between the cylindrical raw material 3 and the molding surface 126 of the mandrel 12 when the cylindrical raw material 3 is drawn by the rotary pressing device 2. Therefore, there is a seventh inconvenience in that it takes much time and labor to draw the cylindrical raw material 3 along the molding surface 126.

Also, in the prior art, when a vehicle wheel is spin molded, the wheel raw material is mounted on the molding mandrel and the wheel raw material is drawn by a pressing member along the molding surface of the mandrel while rotating the mandrel.

However, in such conventional spin molding process as mentioned above, the connecting portion between a spoke portion of a vehicle wheel and a rim portion is necessarily great in view of necessity of providing a drawing gradient to the mandrel. Therefore, there is an eighth inconvenience in that the weight of such a vehicle wheel easily becomes heavy.

Also, in the conventional spin molding, a cast raw material to be molded is placed on the mandrel and the raw material to be molded is drawn into a predetermined shape along the mandrel while rotating the raw material to be molded together with the mandrel and pressing the same with a pressing spatula.

However, as such spin molding process as mentioned above is a molding process which utilizes ductility of the cast raw material to be molded, there is a ninth inconvenience in that when such raw material to be molded is rapidly machined into a complicated shape, difficulty occurs in the raw material to be molded and cracks readily occur.

Also, in the spin molding apparatus, the raw material to be molded is drawn by the pressing member along the molding surface of the mandrel while clamping the raw material to be molded between the mandrel and the tail stock and rotating the mandrel. In this case, as for a raw material to be molded having a not-flat clamping surface (tail stock side) of the raw material to be molded, it is designed such that the contact surface of the tail stock is also intimately contacted with the clamping surface. Accordingly, when the raw material to be molded is clamped by the tail stock, correct positioning must be obtained by rotating the tail stock so that each contact surface of the tail stock is tightly contacted with the clamping surface of the raw material to be molded.

However, in the conventional spin molding process, as the tail stock and the mandrel can be independently rotated, when the raw material to be molded is to be clamped, a proper position (position where the contact surface of the tail stock can be tightly contacted with the clamping surface of the raw material to be molded) must be determined by rotating the tail stock after the raw material) to be molded is set to the material. Therefore, there is a tenth inconvenience in that when a spin molding is effected, it takes much time and labor for clamping the raw material to be molded.

Also, there is a case where it is required to show size, manufactured date, etc., on a spin molded article such as, for example, a vehicle wheel.

In this case, in the prior art, the above-mentioned items are shown by suitable means (for example, stamping) after the raw material to be molded is subjected to spin molding.

However, this way of showing the above-mentioned items on the vehicle wheel through a separate procedure after spin molding requires two steps of working processes. Therefore, there is an eleventh inconvenience in that the working efficiency of the spin molding is necessarily lowered.

The problem to be solved by the present invention is to eliminate the above-mentioned inconveniences inherent in the prior art.

SUMMARY OF THE INVENTION

It is therefore a first object of the present invention to eliminate the first inconvenience.

This object has been achieved by providing a process for manufacturing a vehicle wheel comprising the steps of preparing a wheel raw material or blank in which the rim raw material is integrally formed at a peripheral edge of a disk member, forming the rim portion by spinning said rim raw material while rotating said wheel material about the axis of said disk member, and thereafter heat processing such spin molded raw material, and then cut machining the same, characterized in that said process further comprises the step of forming the thickness of only both edges of said rim portion greater than the final dimensions. The first object has also been achieved by providing a process for manufacturing a vehicle wheel, wherein both edges of said rim portion are a rim hump portion and a rim flange portion.

A second object of the present invention is to eliminate the second inconvenience.

This second object has been achieved by providing a spin molding apparatus for a vehicle wheel comprising a molding die, on the periphery of which the wheel raw material or blank is placed, and a rotary pressing device separately prepared and adapted to draw said wheel raw material together with said molding die, characterized in that a drop center molding portion in said molding die is cut in the vertical direction through the axis thereof and an auxiliary molding die is disposed in the cutting plane.

A third object of the present invention is to eliminate the third inconvenience.

This third object has been achieved by providing a spin molding material containing Si: 3–6 weight percent and Mg: 0.2–0.5 weight percent.

A fourth object of the present invention is to eliminate the fourth inconvenience.

This fourth object has been achieved by providing a spin molding process comprising the steps of integrally forming cylindrical raw material to be molded with the peripheral edge of a plate portion to be clamped, and spin molding said cylindrical raw material, which is in engagement with the outer periphery of a molding mandrel, into a predetermined shape, characterized in that said process further comprises the step of forming a peripheral portion of said cylindrical raw material on the highest projecting portion of a molding surface in said molding mandrel when said cylindrical raw material is mounted on said molding mandrel.

A fifth object of the present invention is to eliminate the fifth inconvenience.

This fifth object has been achieved by providing a spin molding process comprising the steps of integrally forming cylindrical raw material to be molded with the peripheral edge of a plate portion to be clamped, and spin molding said cylindrical raw material which is in engagement with the outer periphery of a molding mandrel into a predetermined shape, characterized in that said process further comprises the step of forming the thickness of the peripheral edge portion in said cylindrical raw material greater than that of the reminder.

A sixth object of the present invention is to eliminate the sixth inconvenience.

This sixth object has been achieved by providing a spin molding process comprising the steps of integrally forming a cylindrical raw material to be molded with the peripheral edge of a plate portion to be clamped, and spin molding said cylindrical raw material which is in engagement with the outer periphery of a molding mandrel into a predetermined shape, characterized in that said process further comprises the step of forming a peripheral groove-like twisted portion on an outer wall surface of a generally connecting portion between said cylindrical raw material to be molded and said plate portion to be clamped.

A seventh object of the present invention is to eliminate the seventh inconvenience.

This seventh object has been achieved by providing a spin molding process comprising the steps of integrally forming a cylindrical raw material to be molded with the peripheral edge of a plate portion to be clamped, and spin molding said cylindrical raw material which is in engagement with the outer periphery of a molding mandrel into a predetermined shape, characterized in that said process further comprises the step of forming a gap between said cylindrical raw material to be molded and said molding mandrel when said cylindrical raw material to be molded is mounted on said molding mandrel, said gap being formed such that it becomes gradually greater in width as it goes toward the peripheral edge thereof. The seventh object has also been achieved by providing a spin molding process, wherein an angle formed between said cylindrical raw material to be molded and the molding surface of said molding mandrel is about 5-30 degrees. The seventh object has also been achieved by providing a spin molding material comprising a plate portion to be clamped, a cylindrical raw material to be molded integrally formed with the peripheral edge of said plate portion to be clamped, and a molding mandrel with the outer periphery of which said raw material to be molded is engaged when said raw material to be molded is spin molded into a predetermined shape, characterized in that said cylindrical molding material to be molded is gradually dilated as it goes toward the peripheral edge thereon and the dilating angle is steppingly changed as it goes toward the peripheral edge thereof. The seventh object has also been achieved by providing a spin molding material, wherein said dilating angle of said cylindrical raw material to be molded becomes steppingly greater. The seventh object has also been achieved by providing a spin molding material, wherein said dilating angle of said raw material to be molded is greater than the dilating angle of said molding surface.

An eighth object of the present invention is to eliminate the eighth inconvenience.

This eighth object has been achieved by providing a spin molding cylindrical raw material having a groove portion formed on the inner peripheral surface of a cylindrical body along the width direction thereof. The eighth object has also been achieved by providing a spin molding process of a cylindrical body comprising the steps of fixing a spin molding cylindrical raw material having a groove portion formed on the inner peripheral surface of said cylindrical body along the width direction thereof, to the outer surface of a mandrel, rotating said cylindrical raw material by rotating said mandrel about the axis thereof, and drawing said cylindrical body along a molding surface of said mandrel while partly pressing the peripheral surface of said cylindrical body with a pressing device.

A ninth object of the present invention is to eliminate the ninth inconvenience.

This ninth object has been achieved by providing a spin molding apparatus comprising a mandrel on which a cast raw material to be molded is placed, heating means for heating said cast raw material to be molded which is being rotated in accordance with rotation of said mandrel, and a pressing spatula for pressing said rotating cast raw material to be molded so that said cast raw material to be molded is drawn along said mandrel, characterized in that the components of said cast raw material to be molded are as follows:

Si; 5.0-9.0%, Mg; 0.15-0.4%, Ti≦ 0.2%, Fe<0.3%, Al: remainder, or

Si <0.2%, Mg; 2.5-5.5%, Ti<0.2%, Mn<0.6%, Al: remainder.

The ninth object has also been achieved by providing a spin molding apparatus, wherein said cast raw material to be molded can be heated to about 230°-400° C. by said heating means. The ninth object has also been achieved by providing spin molding apparatus for a vehicle wheel comprising a mandrel on which a cast raw material to be molded is placed, heating means for heating said cast raw material to be molded which is being rotated in accordance with rotation of said mandrel, and a pressing spatula for pressing said rotating cast raw material to be molded so that said cast raw material to be molded is drawn along said mandrel, characterized in that the components of said cast raw material to be molded are as follows:

Si; 5.0-9.0%, Mg; 0.15-0.4%, Ti<0.2%, Fe<0.3%, Al: remainder, or

Si<0.2%, Mg; 2.5-5.5%, Ti<0.2%, Mn<0.6%, Al: remainder.

The ninth object has also been achieved by providing a spin molding apparatus of a vehicle wheel, wherein said cast raw material to be molded can be heated to about 230°-400° C. by said heating means.

A tenth object of the present invention is to eliminate the tenth inconvenience.

This tenth object has been achieved by providing a spin molding apparatus comprising a base, a molding mandrel and a tail stock arranged on said base such that axes of said mandrel and tail stock are aligned, said mandrel and tail stock being reciprocally movable along said axes and being rotatable about said axes, and a pressing member for drawing said raw material to be molded clamped by said mandrel and said tail stock along a molding surface of said mandrel into predetermined shape while rotating said mandrel, characterized in that said spin molding apparatus further comprises a retaining rod reciprocally movably disposed on said base for movement with respect to the tail stock direction; and a retaining portion mounted on said tail stock such that said tail stock can be retained by said retaining portion.

An eleventh object of the present invention is to eliminate the eleventh inconvenience.

The eleventh object has been achieved by providing a spin molding apparatus comprising a spin molding mandrel having a raw material to be molded placed thereon, and a pressing member for pressing said raw material to be molded along a molding surface of said mandrel while rotating said mandrel about the axis thereof, so that said raw material to be molded is molded into a predetermined shape, characterized in that a displaying irregular portion is formed on said molding surface of said mandrel.

DETAILED DESCRIPTION OF THE PREFERRED EMBODIMENTS

An embodiment of the invention will now be described with reference to FIG. 1.

Figure 1:
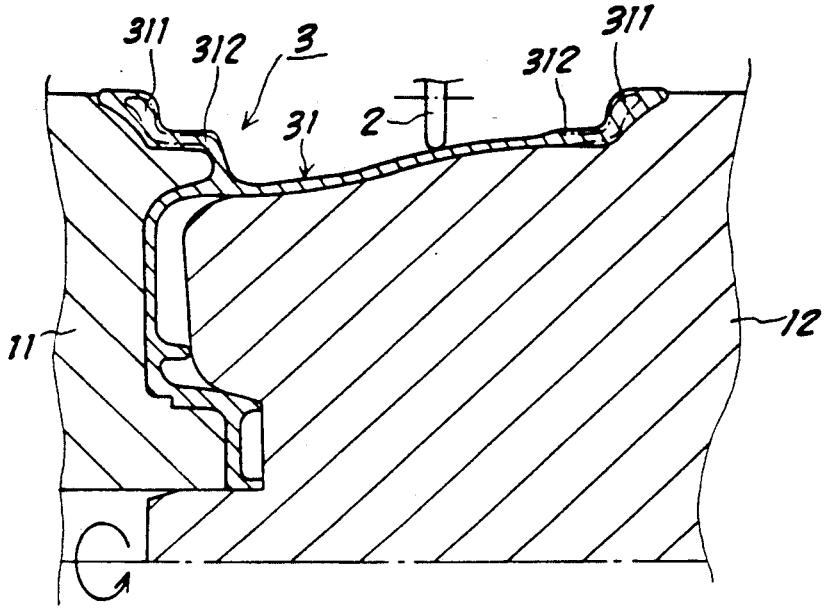
FIG. 1 is a sectional view showing an embodiment of the invention.

In FIG. 1, a pair of mandrels 11, 12 which are rotatable (see the arrow) about the axis thereof. Similarly, a rotary pressing device 2, forms a pair with the mandrels 11, 12 used when an intermediate raw material blank 3 of a vehicle wheel, as will be described hereinafter, is spin molded. The intermediate raw material 3 of a vehicle wheel is sandwiched by the mandrels 11, 12. This vehicle wheel intermediate raw material 3 is spin molded or formed by sandwiching the raw material for a wheel (not shown) between the mandrels 11, 12 and drawn, while rotating, along the outer surfaces of the mandrels 11, 12 by the rotary pressing device 2. When the vehicle wheel intermediate raw material 3 is formed, the thickness of a rim flange portion 311 and the thickness of a rim hump portion 312 in a rim portion 31 are formed greater than the final dimensions (shown by one dotted chain lines in FIG. 1). After removal from the mandrels 11, 12, the vehicle wheel intermediate raw material 3 is heated and then the thickness of the rim flange portion 311 and the thickness of the rim hump portion 312 are finished to the final thickness to obtain a vehicle wheel.

When the rim portion is formed through spin molding, the thickness of only the peripheral edge portion of the rim portion is formed greater than the final thickness and the cutting treatment after heat treatment is applied only to the peripheral edge portion. Accordingly, the portion requiring a cutting treatment in the succeeding processes becomes less.

As a consequence, if the manufacturing process of a vehicle wheel is employed, it does not take much time and labor for the cutting treatment after heat treatment which will be performed after the spin molding, the vehicle wheel can be manufactured with ease and the yield of material is improved.

Next, the embodiment will be described with reference to FIG. 2.

Figure 2:
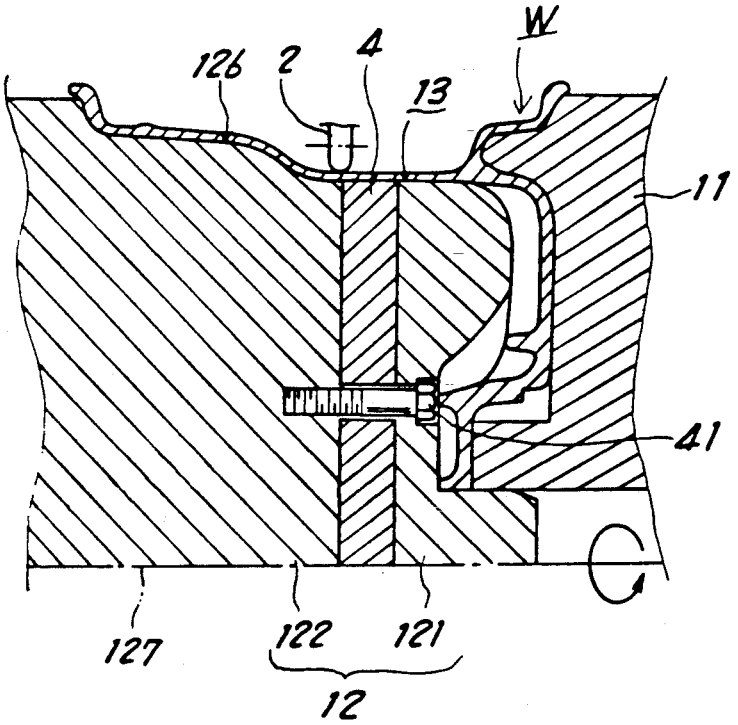
FIG. 2 is a vertical sectional view.

In FIG. 2, a spin molding mandrel 12 (corresponding to the "molding die" of the present invention), which is rotatable about the axis 127 thereof. This mandrel 12, includes a reverse rim molding portion 126, and a drop center molding portion 13. This mandrel 12 is cut in the vertical direction with respect to the axis at the drop center molding portion 13 and split into an outer portion 121 and an inner portion 122. Also, a molding auxiliary die 4 is removably sandwiched between the outer portion 121 and the inner portion 122 in the mandrel 12. The peripheral surface of this molding auxiliary die 4 is flush with the molding portion of the drop center 13 of the mandrel 12 and acts as a drop center molding portion when spin molding. A fixing bolt 41 is adapted to fix the molding auxiliary die 4 to the outer portion 121 and inner portion 122 in the mandrel 12.

A vehicle wheel is molded in such a constructed spin molding die apparatus as mentioned above in the following manner.

First, the vehicle wheel raw material or blank (not shown) is placed on the mandrel 12 such that the raw material is engaged with the outer surface of the mandrel 12 and clamped by the auxiliary mandrel 11. While rotating this raw material about the axis, it may simply be drawn by the rotary pressing device 2 in the direction as shown by the arrow. As a result, a vehicle wheel as shown in FIG. 2 is formed. In this case, the peripheral surface of the molding auxiliary die 4 forms a part of the drop center of the vehicle wheel W.

As the spin molding device of a vehicle wheel is constructed in the manner as mentioned above, the width of the rim of the vehicle wheel to be spin molded is adjustable by changing the width of this molding auxiliary die.

Accordingly, if several kinds of molding auxiliary dies are prepared beforehand and properly selected in accordance with necessity, vehicle wheels having different rim widths can be spin molded in the present form of a molding die.

Therefore, if the spin molding die apparatus of a vehicle wheel according to the present invention is employed, it is no longer required to prepare several kinds of molding dies (mandrels) in order to spin mold vehicle wheels which have different rim widths. As a consequence, the manufacturing cost of the molding die (mandrel) can be decreased and the maintenance of the molding die (mandrel) becomes comparatively easy.

Figure 4:
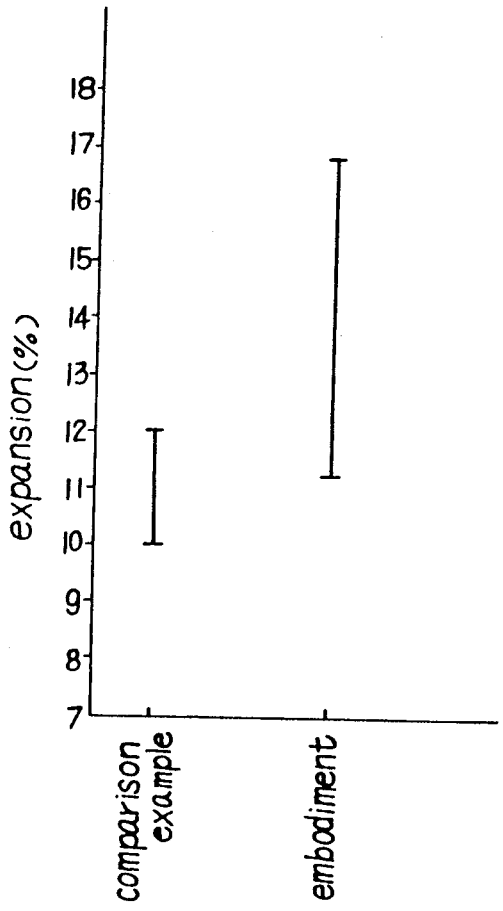
FIG. 4 is likewise a graph showing expansion thereof.
Figure 3A:
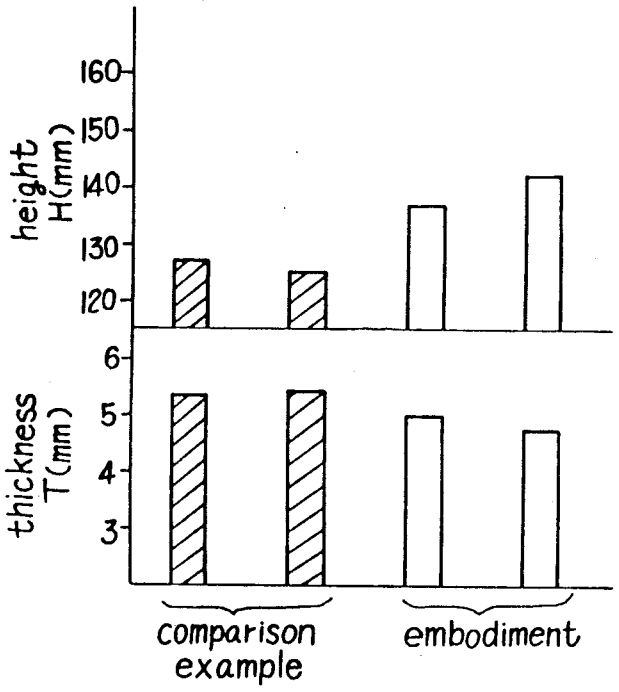
FIGS. 3*a* and 3*b* are graphs showing moldability.
Figure 3B:
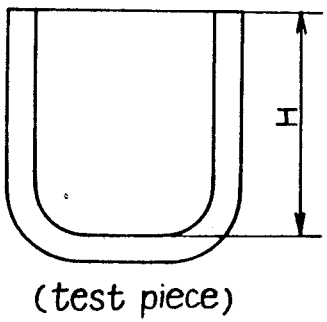

In the spin molding material, (1) the content of Si is limited to 3-6 wt,% because if it is 3 wt.% or less, the hot melt fluidity is lowered during casting and an ingot piping is easily generated. As shown in FIGS. 3 and 4, if the content of Si is 6 wt.% or more, the expanding property is lowered although sufficient strength of the vehicle wheel can be assured, (2) the content of Mg is limited to 0.2-0.5 wt.% because if it s 0.2 wt.% or less, the tensile strength is lowered as shown in FIG. 4, and also, if it is 0.5 wt.% or more, the expansion property of the vehicle wheel is lowered.

A vehicle wheel raw material blank was cast from a spin molding low Si material (Cu: 0.003 wt.%, Si: 4.6 wt.%, Mg. 0.36 wt.%, Fe: 0.12 wt.%, Mn: 0.004 wt.%, Ti: 0.10 wt.%, Sb: 0.078 wt.%, and remainder: Al), and this wheel raw material was spin molded to manufacture a vehicle wheel. The test results of the expansion in this vehicle wheel are shown in FIGS. 3 and 4. The test was carried out in such a manner that a dish-shaped (thickness: 10 mm) test piece was made and the dish-shaped test piece was molded by a spinning machine.

Comparison Example (Prior Art)

A vehicle wheel raw material blank was cast from a spin molding 4C material (Cu: 0.006 wt.%, Si: 6.9 wt.%, Mg. 0.33 wt.%, Fe: 0.12 wt.%, Mn: 0.006 wt.%, Ti: 0.115 wt.%, Sb: 0.112 wt.%, and remainder: Al), and this raw material was spin molded to manufacture a vehicle wheel. The test results of the expansion in this vehicle wheel are shown in FIGS. 3 and 4. The test was carried out in the same procedure as the embodiment.

As the spin molding material of the invention is constructed in the manner as mentioned above, if the spinning raw material is cast and this raw material is molded, the moldability is goods because the expansion is excellent as shown in FIGS. 3 and 4.

Next, an embodiment of the invention will be described with reference to FIG. 5.

Figure 5:
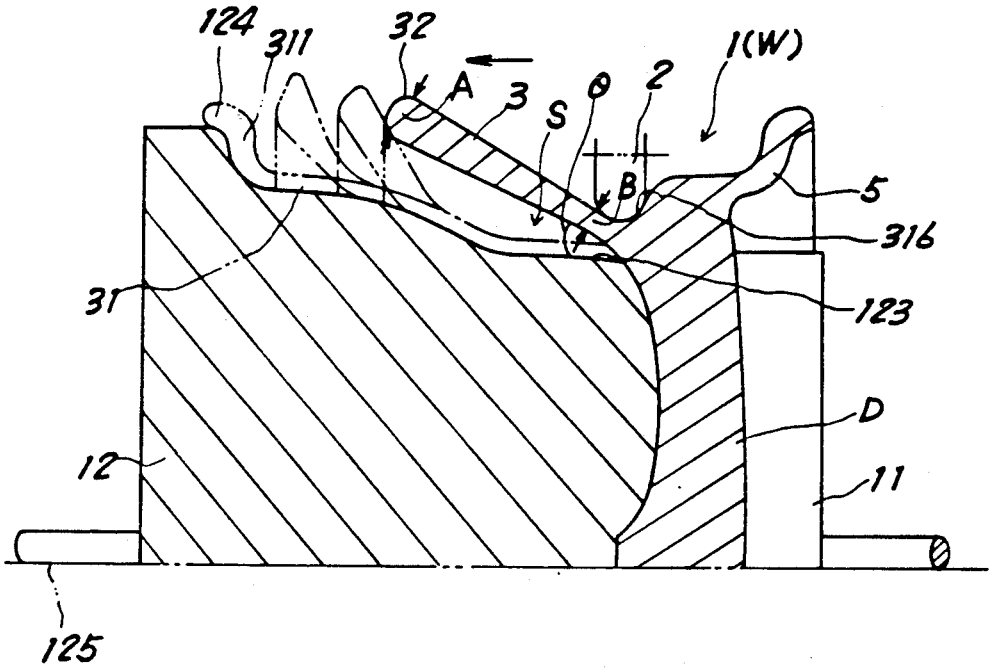
FIG. 5 is a sectional view showing the process in which a raw material of a vehicle wheel is placed on a mandrel.

In FIG. 5, the reference character D denotes a disk portion or "plate portion to be clamped" of the vehicle wheel raw material 1, and an outer side rim portion 5 is integrally formed on the outer peripheral edge portion of this disk portion D by forging or casting. A reverse side cylindrical rim raw material 3, that is, the "cylindrical raw material to be molded" is integrally formed on the reverse side peripheral edge portion of the disk portion D by forging or casting as in the case with the outer side rim portion 5. This reverse side cylindrical rim raw material 3 is made into a reverse side rim portion 31 by the spin molding, and the thickness A of the peripheral edge portion 32 is greater than the thickness B of the root and trunk portion. Also, a twist 316 is formed on the outer wall surface at the connecting portion between the reverse side cylindrical raw material 3 and the disk portion D. This twist 316 extends like a groove over the peripheral surface of the reverse side cylindrical raw material 3.

Such a constructed vehicle wheel raw material blank 1 is placed on the mandrel 12. In this case, a gap S is formed between the reverse side cylindrical raw material 3 and the rim molding surface 123 of the mandrel 23. The angle $\theta$ formed between the reverse side cylindrical raw material 3 and the rim molding surface 123 is preferably about 8 degrees. Also, a front end portion 32 of the cylindrical rim raw material 3 is further projected (in the radial direction of the disk portion D) than the rim flange molding surface or "most projected portion" of the mandrel 12.

By rotating the mandrel 12 about the axis 125 and drawing the reverse side cylindrical raw material 3 in the arrow direction by the rotary pressing device 2, the cylindrical raw material 3 is gradually deformed into the state as shown by the imaginary line (from the right-hand side to the left-hand side) to form the reverse side rim 31 and thus the vehicle wheel W.

A pressing plate 11 clamps the wheel rim material 1 to the mandrel 4.

As the spin molding process is constituted in the manner as mentioned above, when the cylindrical raw material to be molded along the molding surface of the mandrel, the cylindrical raw material to be molded easily conforms to the molding surface along its projecting portion.

Thus, if this spin molding process is used, the cylindrical raw material to be molded can be easily molded along the projecting molding surface (of the mandrel).

Also, as the spin molding process is constituted in the manner as mentioned above, when the cylindrical raw material to be molded is drawn along the projected part of the molding surface of the mandrel, there is sufficient raw material for working.

Therefore, if the spin molding process is used, when the cylindrical raw material to be molded is drawn along the projected part of the molding surface, the thickness of the rising part can be maintained to a predetermined dimension with ease.

Also, as the spin molding process is constituted in the manner as mentioned above, the connecting portion between the cylindrical raw material to be molded and the plate portion to be clamped can be made comparatively thin. Consequently, when such raw material as mentioned is cast, a decayed part does not easily occur at the connecting portion. As a result, the strength of the spin molded product can be maintained with ease.

Next, an embodiment will be described with reference to FIG. 6.

The vehicle wheel raw material blank 1 is placed on the mandrel 12. In this case, a gap S is formed between the reverse side cylindrical raw material 3 and the rim molding surface 123 of this mandrel 12 in such a manner that the gap S is gradually dilated as it goes toward the front end portion of the reverse side cylindrical raw material 3. The angle $\theta$ formed between reverse side cylindrical raw material 3 and the rim molding surface 123 is preferably about 5 to 30 degrees. If the angle $\theta$ is less than 5 degrees, when the rotary pressing device (roller) 2, as will be described hereinafter, is pressed against the reverse side cylindrical raw material 3, the bottom surface on the front end side from the pressed portion in the reverse side cylindrical raw material 3, contacts the molding surface of the mandrel 12. As a consequence, the amount of drawing each time the pressing device 2 passes is limited; it is required to repeat such drawing several times in order to achieve this object.

On the other hand, if the angle $\theta$ exceeds 30 degrees, when the rotary pressing device (roller) 2 as will be described hereinafter is pressed against the reverse side cylindrical raw material 3, the contact area between the reverse side cylindrical raw material 3 and the rotary pressing device (roller) 2 becomes too large. As a result, there is a fear that the reverse side cylindrical raw material 3 will be broken in the middle.

Also, the front end portion 32 of the cylindrical rim raw material 3 is larger in diameter in the radial direction of the disk portion D than the rim flange molding surface of the mandrel 12.

Also, as the spin molding process is constituted in the manner as mentioned above, when the cylindrical raw material to be molded is drawn along the molding surface of the mandrel, such cylindrical raw material to be molded gets readily shaped to such molding surface.

Accordingly, if this spin molding process is used, it is easy to spin mold the cylindrical raw material into a predetermined shape (for example, vehicle wheel) along the molded mandrel.

If the angle formed between the cylindrical raw material to be molded and the molding surface of the molding mandrel is set to 3-30 degrees, working efficiency of the spin molding is greatly improved.

Next, an embodiment will be described with reference to FIG. 6.

Figure 6:
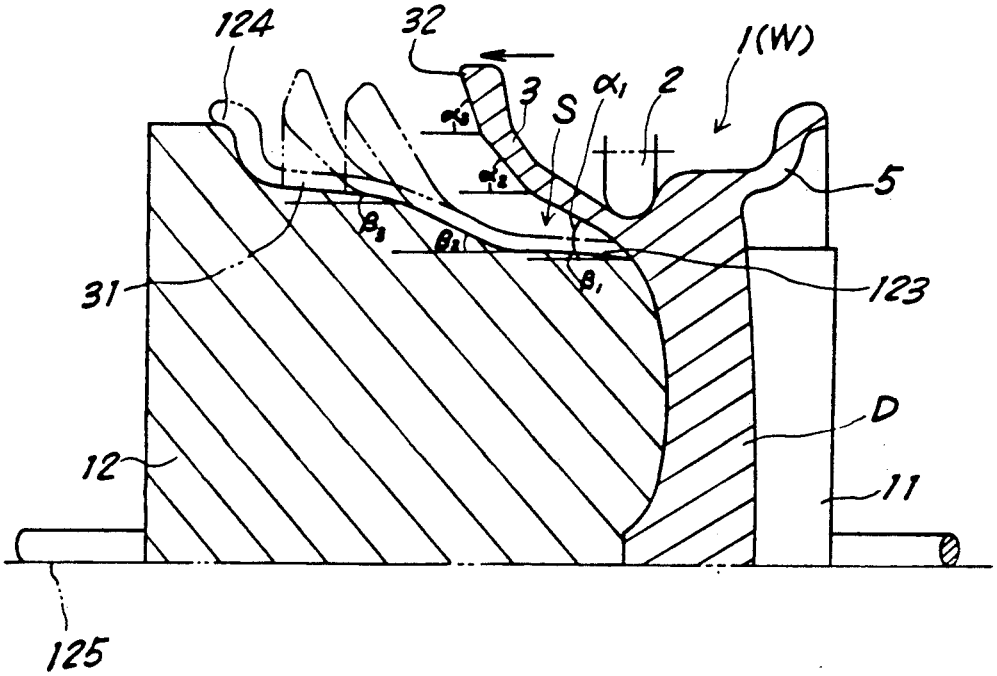
FIG. 6 is a sectional view of the raw material of a vehicle wheel placed on a mandrel.
Figure 7:
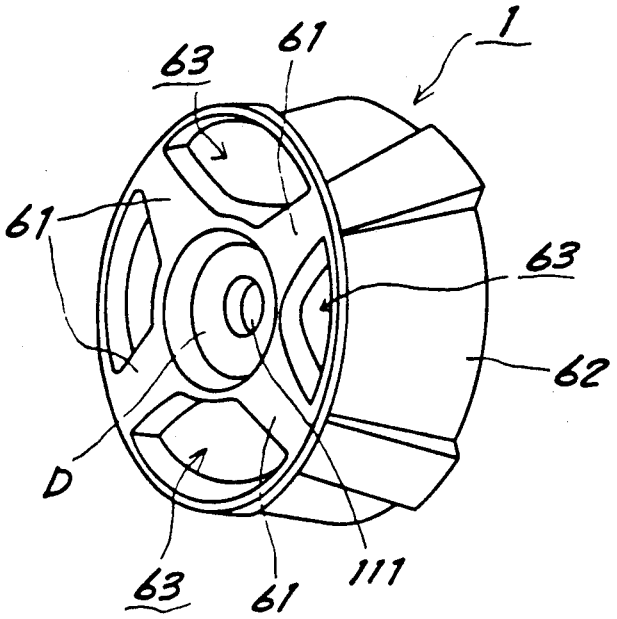
FIG. 7 is a perspective view showing the outer surface of a raw material blank of a vehicle wheel.
Figure 8:
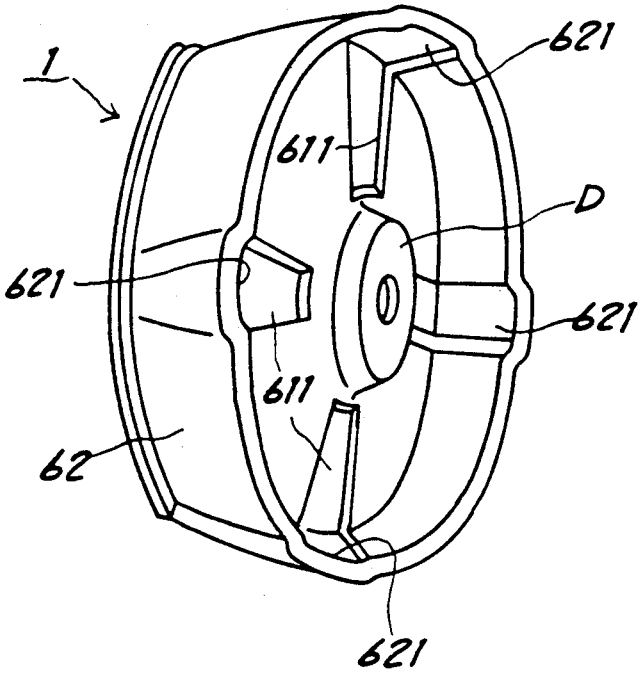
FIG. 8 is likewise a perspective view showing the reverse surface side thereof.
Figure 10:
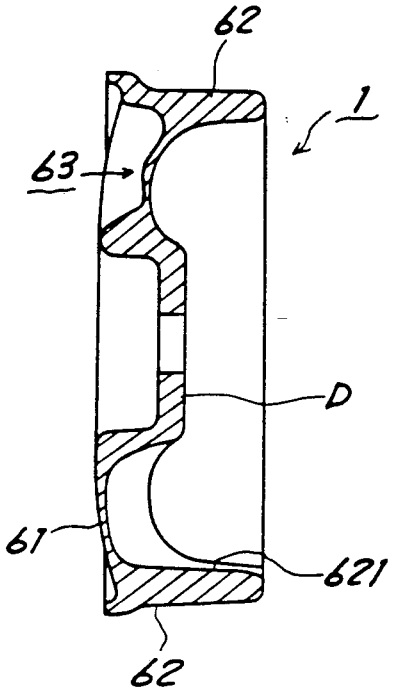
FIG. 10 is a sectional view taken on line X—X of FIG. 9.
Figure 9:
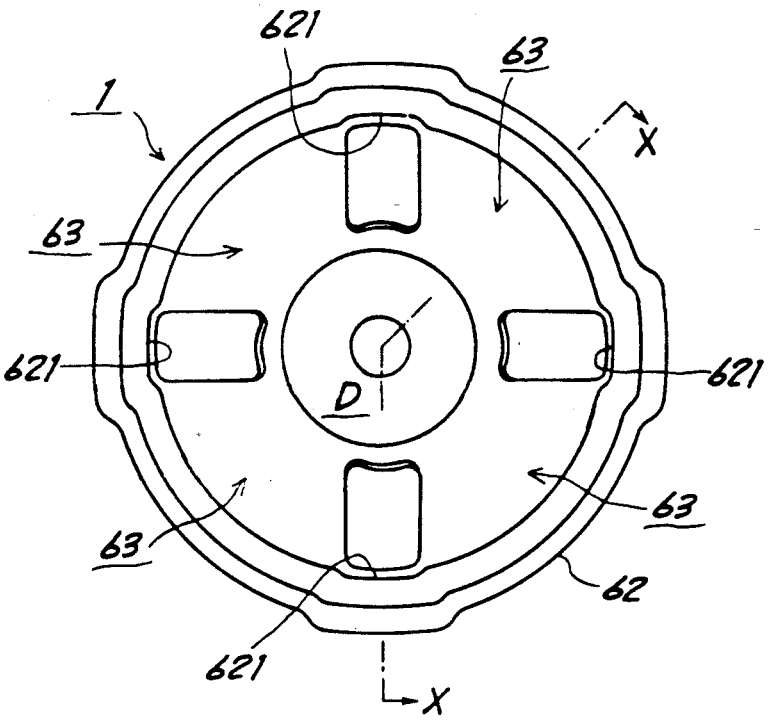
FIG. 9 is a rear view thereof.

In FIG. 6, the reverse side cylindrical raw material 3 is formed into a reverse side rim portion 31 by spin molding and is gradually dilated as it goes toward the front edge thereof. And the dilating angles $a_1$ $a_2$ and $a_3$ become steppingly larger as it goes toward the front edge.

Such constructed vehicle wheel raw material 1 is placed on the mandrel 12. In this case, the dilating angles $\beta_1$, $\beta_2$ and $\beta_3$ of the rim molding surface 123 of this mandrel 12 are smaller than the dilating angles $\alpha_1$, $\alpha_2$ and $\alpha_3$ of the reverse side cylindrical raw material 3. Thus, between the reverse side cylindrical raw material 3 and the rim molding surface 123 of this mandrel 12, a gap S is formed which becomes gradually dilated as it goes toward the front edge.

As the spin molding raw material is constructed in the manner as described above, when the cylindrical raw material to be molded is drawn along the molding surface of the mandrel, such cylindrical raw material to be molded as mentioned above easily gets shaped to the mandrel along its molding surface which is gradually steppingly dilated.

Therefore, if this spin molding process is used, the cylindrical raw material to be molded can easily be spin molded into a predetermined shape (for example, vehicle wheel) which is gradually steppingly dilated along the molding mandrel.

If the dilating angle of the cylindrical raw material to be molded is steppingly increased, the working performance of the spin molding work is much improved.

Furthermore, if the dilating angle of the cylindrical raw material to be molded is formed larger than the dilating angle of the molding surface (of the molded mandrel), the working performance of the spin molding work is much improved.

Next, an embodiment will be described with reference to FIGS. 7 through 12.

In FIGS. 7 through 12, the vehicle wheel raw material blank 1 is integrally formed by forging. This vehicle wheel raw material 1, as will be described hereinafter, is molded into a vehicle wheel by spin molding. Reference character D denotes a disk portion of the wheel raw material 1, and the numerals 61, 61, . . . denote spoke portions thereof. The spoke portions 61, 61, . . . radially extend from said disk portion D, and are connected to the edge of a rim portion or cylindrical body. An axle hole 111 is at the center of the disk portion D.

Grooves 621 are formed on the inner peripheral surface of the rim portion 62 by warping the rim portion 62 outward. Each of the grooves 621 extends in the width direction (of the rim portion 62) from the connecting portion of the spoke portion 61.

Also, auxiliary grooves 611 are formed on the rear sides of the spoke portions 61, 61, . . . . Each auxiliary groove 611 is connected to a groove 621 of the rim portion 62, respectively. In the state of the wheel raw material 1, window portions 63, 63, . . . are not yet penetrated.

Next, with reference to FIGS. 11 and 12, there will be described a spin molding process in which the wheel raw material 1 is used.

Figure 11:
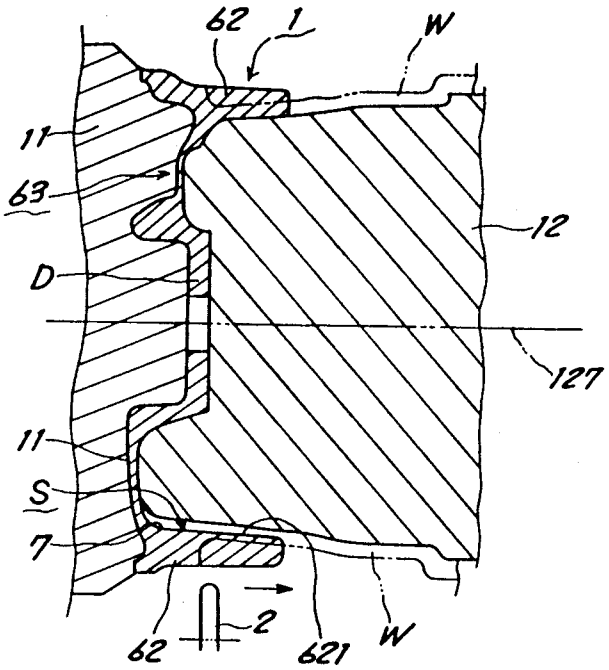
FIG. 11 is a sectional view showing the raw material of a vehicle wheel (FIGS. 7-10) placed on a mandrel.

In FIG. 11, a spin molding mandrel 12 is rotatable about the axis 127. The wheel raw material 1 or blank is engaged with the outer periphery of this mandrel 12, which is clamped by a tail stock 11. At this time, gaps S, S, generally corresponding to the depth of a groove portion 621 are created between the bottom surface of the groove portion 621 in the wheel raw material 1 and the molding surface of the mandrel 12. These gaps S, S, . . . extend in the width direction of the rim portion 62.

In this state, while rotating the mandrel 12 about the axis 127, the pressing device 2 is abutted against the generally intermediate portion of the rim portion 62 and the rim portion 62 is drawn outside by this pressing device 2 along the direction as shown by the arrow from this intermediate portion. By this, a vehicle wheel W (the state shown by the imaginary lines of FIG. 11) is spin molded. Then, the recess portion 7 is formed in the root (the connecting portion to the spoke portion 61) of the rim portion 62.

Figure 12:
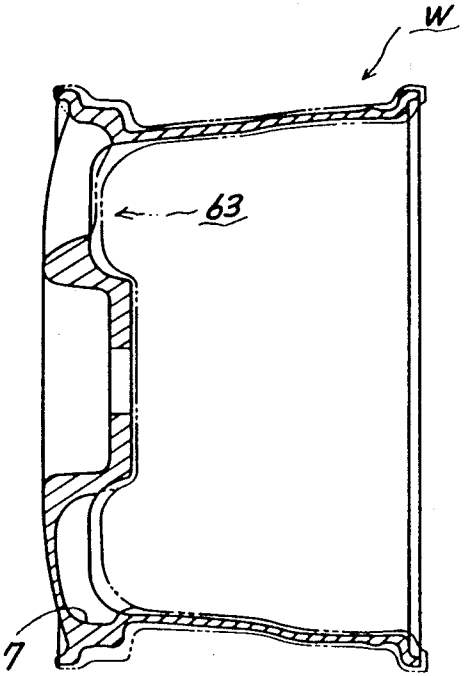
FIG. 12 is a sectional view of a final product of a vehicle wheel of FIG. 11.

As is shown in FIG. 12, a final product (shown by the solid line) can be obtained by cutting the vehicle wheel (see the imaginary line of the figure) which was subjected to the spin molding. At this time, the window portions 63, 63, 63, . . . are penetrated.

As the spin molding cylindrical raw material is constructed in the manner as described above, if this cylindrical raw material is fixed to the mandrel and drawn along the molding surface of the mandrel while partly pressing the outer peripheral surface of the cylindrical body in the cylindrical raw material with the pressing device by rotating the mandrel, the recess portion can be intermittently formed in the inner peripheral surface of the cylindrical body. As a consequence, the cylindrical body can be made light in weight.

Also, as the spin molding cylindrical raw material is constructed in the manner as described above, the recess portion can be formed by spin molding.

Accordingly, if the spin molding process of this cylindrical body is used, contrary to the prior art, the recess portion can be formed in the inner peripheral surface of the root and truck portion (connecting portion between the rim portion of the vehicle wheel and the spoke portion) of the cylindrical body which is spin molded. Thus, the cylindrical body can be made light in weight.

Next, an embodiment will be described with reference to FIG. 13.

Figure 13:
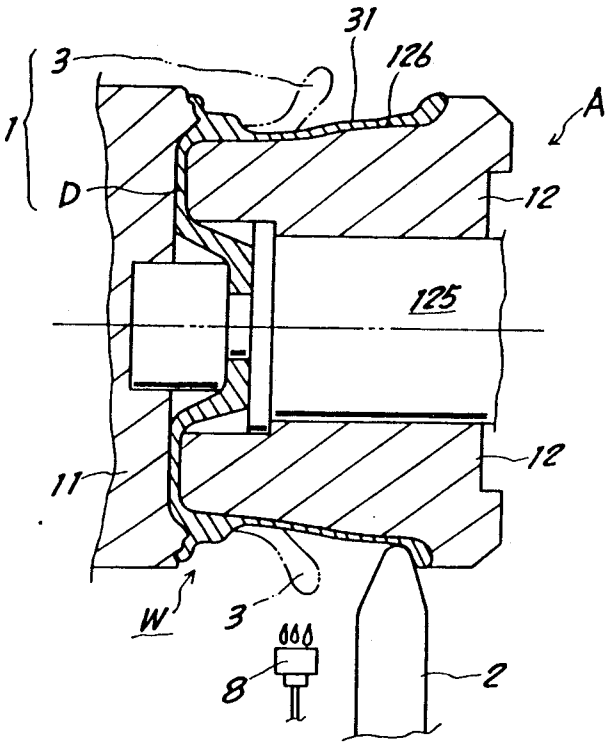
FIG. 13 is a sectional view of an alternative embodiment.

In FIG. 13, reference character A denotes a spin molding apparatus having a rotational shaft 125. This rotational shaft 125 is rotatable about the axis thereof. A mandrel 12 is removably engaged with the outer periphery of the rotational shaft 125. The peripheral surface of this mandrel 12 forms a die portion 126 for spin molding a vehicle wheel W. The numeral 1 denotes a cast vehicle wheel raw material blank of the present invention, and the components thereof are Si; 5.0–9.0%, Mg; 0.15–0.4%, Ti; <0.2%, Fe; <0.3%, Al: remainder, or Si<0.2%, Mg:2.5–5.5%, Ti<0.2%, Mn<0.6%, Al: remainder. It may be cast from an AC4 material. This vehicle wheel raw material 1 is disposed on one side of the mandrel and clamped by the tail stock 11. Owing to the foregoing, in accordance with the rotation of the mandrel 12, the vehicle wheel raw material 1 is rotated in the same direction. This vehicle wheel raw material 1 is made by casting and comprises a disk portion D, which is sandwiched between the mandrel 12 and the tail stock 11, and a rim raw material 11 (see the imaginary line of the figure). If the rim raw material 3 is drawn in the direction as shown by the arrow with the pressing spatula 2 while rotating the mandrel 12, the rim 31 is spin molded. A burner 8 (corresponding to the "heating means" of the present invention) is adapted to heat the rim raw material 3. This burner 8 is disposed on the pressing spatula 2 and moved in accordance with the movement of the pressing spatula 2. Owing to the foregoing, the working portion of the pressing spatula 2 can be partly heated. When the rim 31 is spin molded, the raw material 3 is preferably heated to 230°–400° C. by a burner 8. The reason is that if the temperature is less than 230° C., moldability becomes poor and cracks occur, while if the heating temperature is 400° C. or more the disk portion (vehicle wheel raw material 4) D becomes too soft and is easily deformed. Also, in order to set the rim raw material 3 within the temperature range (230°–400° C.), the temperature of the molding portion of the rim raw material 3 is measured by an infrared thermometer and the heating power of the gas burner 8 is adjusted in accordance with a feed back system. Upon start of the rotation of the mandrel 12, the burner 8 is ignited and the burner is extinguished upon stopping rotation.

In order to spin mold the vehicle wheel by such spin molding apparatus S, first, the cast vehicle wheel raw material blank 1 is placed on the mandrel 12. And after clamping by the tail stock 11, the mandrel 12 is rotated at approximately 300 RPM. At this time, the burner 8 is ignited simultaneously and starts heating the rim raw material 3. When the temperature of the rim raw material has reached a predetermined temperature (230°–400° C.), this rim raw material 3 is drawn in the direction as shown by the arrow by pressing the spatula 2 to obtain the vehicle wheel W. After molding the vehicle wheel W, rotation of the mandrel 12 is stopped. At this time, the gas burner 8 is extinguished simultaneously.

In addition to heating the cast molding raw material to be molded, the mandrel and/or the pressing spatula may be heated.

As the spin molding apparatus is constructed in the manner as described above, the spin molding can be carried out while maintaining the good ductility of the cast raw material to be molded. As a result, the cast raw material to be molded can be drawn along the mandrel with ease. Therefore, even when the cast raw material to be molded is rapidly machined into a complicated shape, unreasonable conditions are not imposed on the cast raw material to be molded. As a result, cracks are infrequently created in such raw material.

It is desirable that the raw material to be molded can be heated to 230°–400° C. by the heating means. The reason is that if the heating temperature is less than 230° C., the moldability becomes poor and cracks are created On the other hand, if the heating temperature is 400° C. or more, the raw material to be molded becomes too soft and the mandrel fixing portion in the raw material to be molded is easily deformed.

Accordingly, if the spin molding apparatus according to the present invention is used, the cast raw material to be molded can be rapidly machined into a complicated shape with ease.

Next, an embodiment will be described with reference to FIGS. 14 through 19.

In FIGS. 14 through 19, the axis of a mandrel 12 is aligned with the axis of a tail stock 11. A shaft hole 119 is in the mandrel 12 and a first operation rod 125 is reciprocally movably disposed in the shaft hole 119. This first operation rod 125 is provided with an extruding plate 128 fixed to a front end thereof. This extruding plate 128 is used for removing the vehicle wheel W after forming. Similarly, a second operation rod 91 is reciprocally movably disposed on a substrate F of the spin molding apparatus. The front end of this second operation rod 91 is fixed to the tail stock 11 and used to reciprocally move the tail stock 11 along the axis. A retaining hole 112 (corresponding to the "retaining portion" of the present invention), is formed on the edge of the tail stock 11. A retaining rod 92 is reciprocally movably disposed on the substrate F. By reciprocal movement of the retaining rod 92, it can be engaged with and disengaged from the retaining hole 112 of the tail stock 11.

Next, there will be described a method for using the spin molding apparatus.

Figure 14:
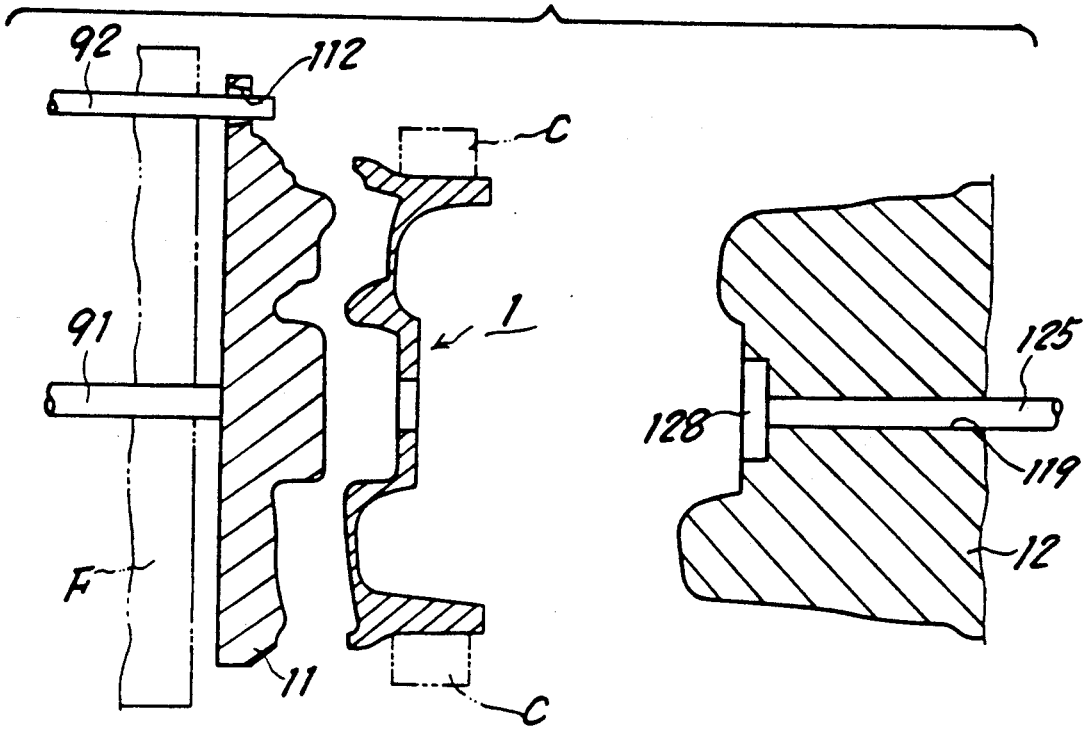
FIGS. 14 through 19 are schematic views showing the steps in producing an alternative embodiment of claim 19.

In FIG. 14, the mandrel 12 is stopped in a suitable position. The tail stock 11 is now in its withdrawn position on the side of the substrate F by means of manipulation of the second operation rod 91. At this time, the retaining rod 92 is engaged in the retaining hole 112 of the tail stock 11. The numeral 1 denotes a vehicle wheel raw material blank (corresponding to the "raw material to be molded") clamped by a chuck member C and disposed between the mandrel 12 and the tail stock 11. The chuck member C is adapted to clamp the vehicle wheel raw material 1.

Figure 15:
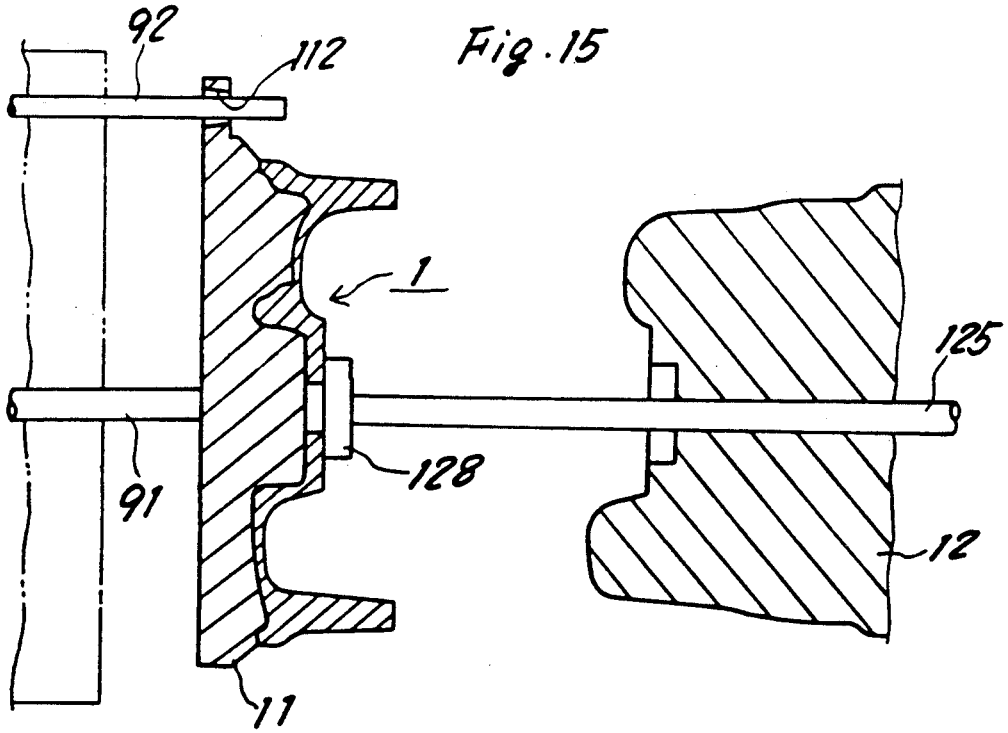

Next, as is shown in FIG. 15, the second operation rod 91 is manipulated to extend the tail stock 11 and the first operating rod 125 is manipulated to extend the extruding plate 128 so that the wheel member 1 is held between the tail stock 11 and the extruding plate 128. At this time, simultaneously with the extension of the tail stock 11, the retaining rod 92 is extended and the retaining state in the retaining hole 112 is maintained.

Figure 16:
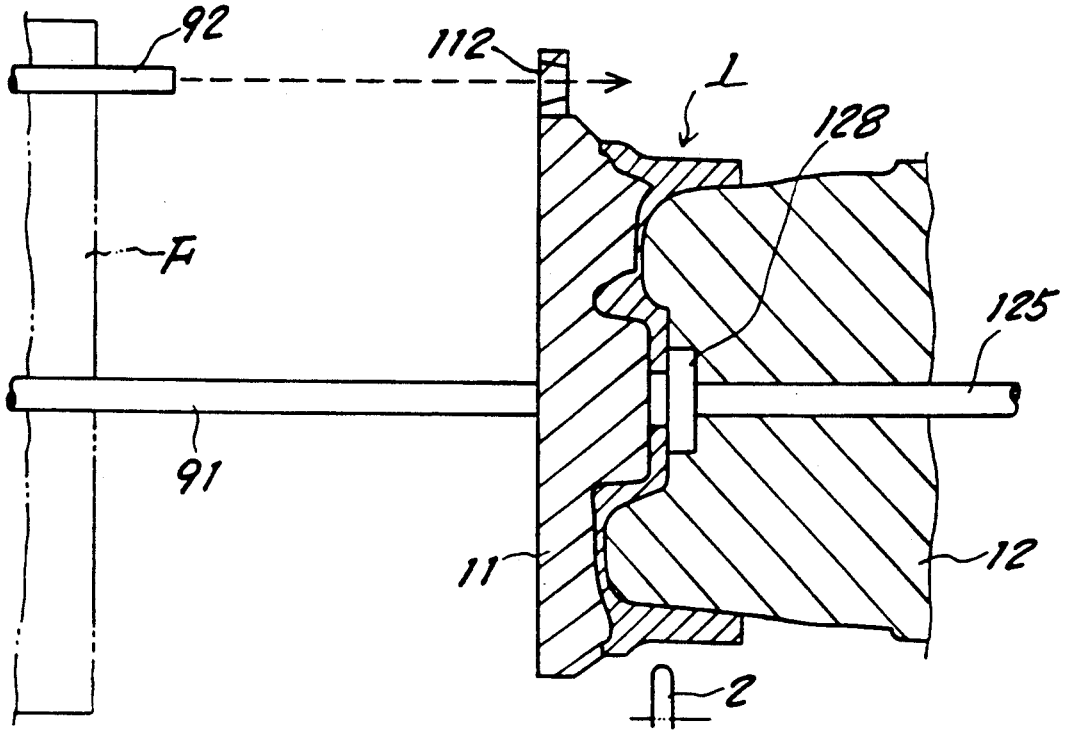
Figure 17:
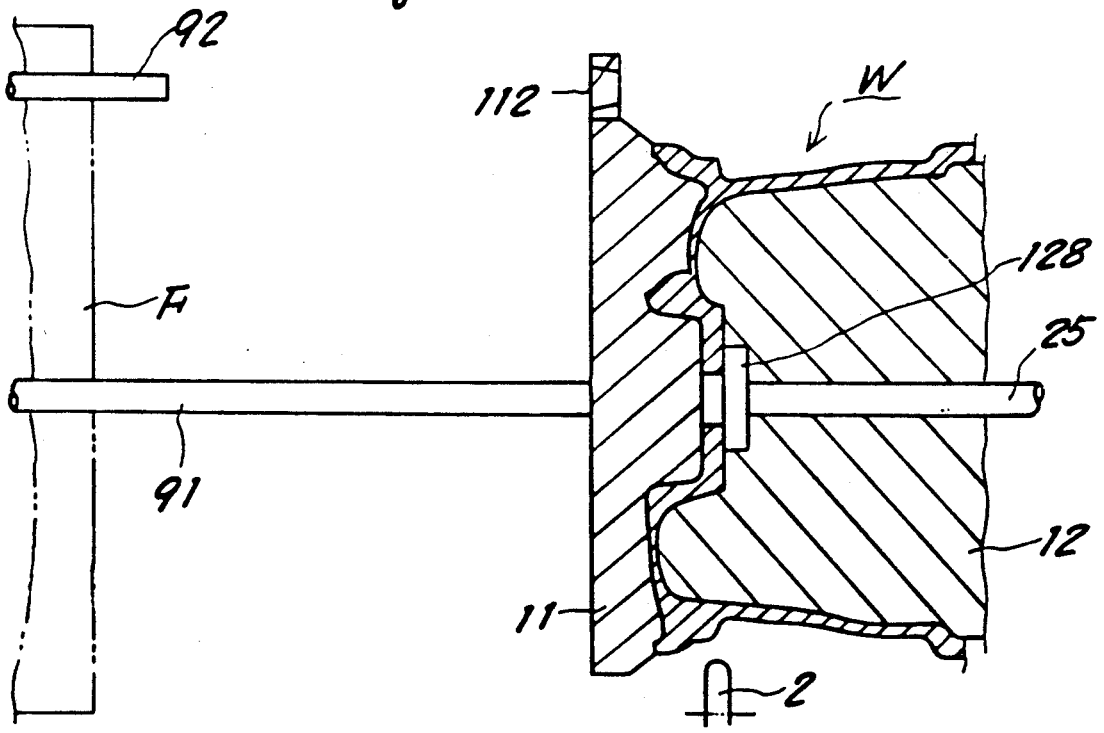

Next, as is shown in FIG. 16, while holding the wheel raw material 1 between the extruding plate 128 and the tail stock 11, the tail stock 11 is further extended and the wheel raw material 1 is intimately contacted with the mandrel 12. At this time, the retaining rod 92 is withdrawn and disengaged from the retaining hole 112 of the tail stock 11. In this state, while rotating the mandrel 12 about the axis, the wheel raw material 1 is drawn along the molding surface (of the mandrel 12) by the pressing member 2, thereby to realize the spin molding of the vehicle wheel W (see FIG. 17).

Figure 18:
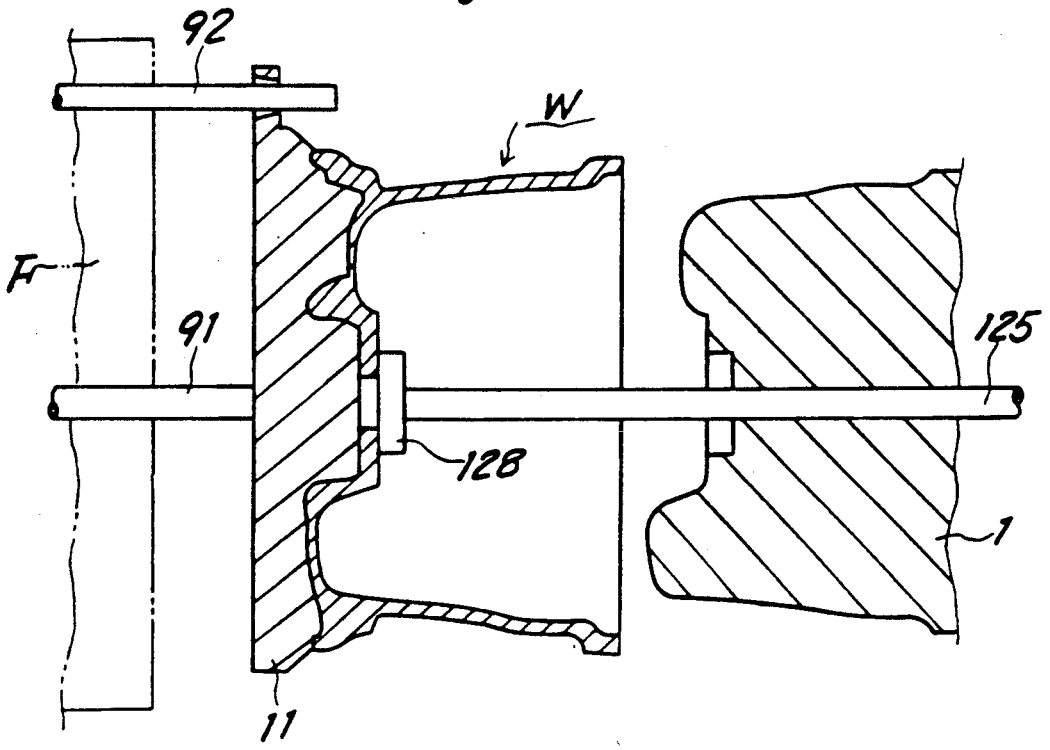

Next, as is shown in FIG. 18, while holding the vehicle wheel W by the extruding plate 128 and the tail stock 11, the extruding plate 128 is extended and the vehicle wheel W is removed from the mandrel 12. At this time, simultaneously with the retraction of the tail stock 11, the retaining rod 92 is extended and engaged in the retaining hole 112. By this, a correct position of the tail stock 11 with respect to the stopped state of the mandrel 12 can be obtained.

Figure 19:
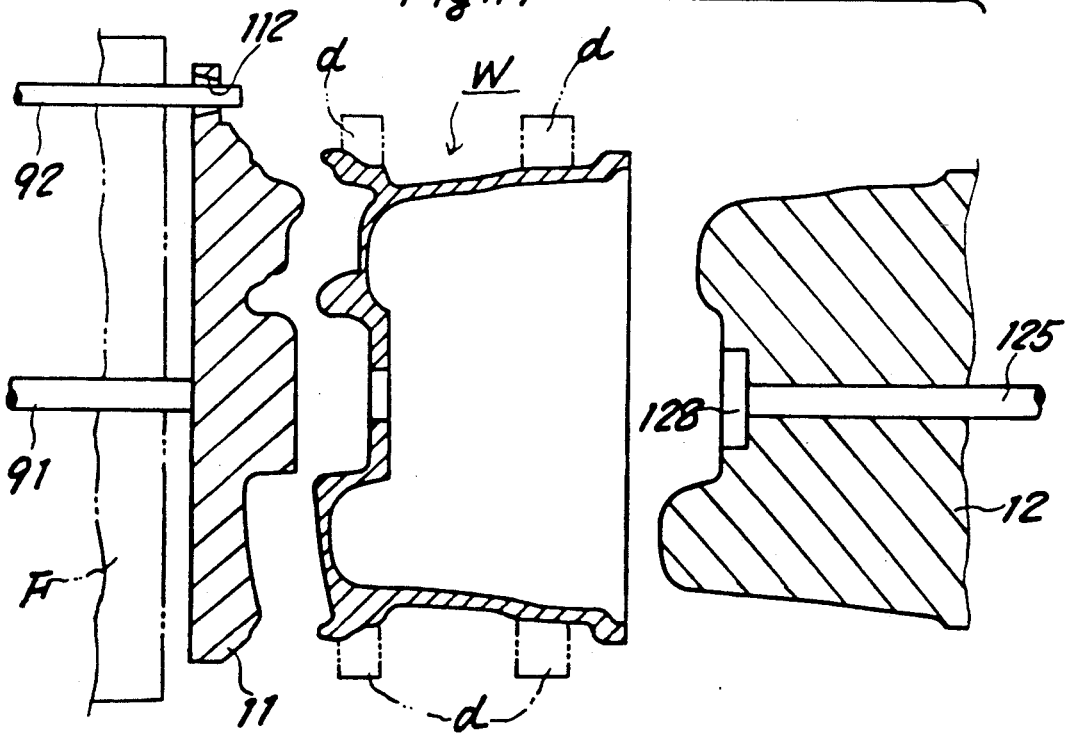

Next, as is shown in FIG. 19, after the vehicle wheel W is held between the chuck members d and d, the second operation rod 91 is manipulated to retract the tail stock 11 and the first operating rod 125 is manipulated to retract the extruding plate 129 in order to release the vehicle wheel W from the tail stock 11 and extruding plate 128. At this time, the retaining rod 92 is also withdrawn in accordance with the withdrawal of the tail stock 11 but its retaining state in the retaining hole 112 is maintained. Thus, the correct position of the tail stock 11 with respect to the stopped state of the mandrel 12 is still maintained.

In this embodiment, there has been described a case where a vehicle wheel is molded. However, it goes without saying that the present invention is likewise applicable to spin molding other apparatus.

The spinning apparatus, which is constructed in the manner as described in the above, is designed such that the corresponding position of the tail stock with respect to the stopped position of the mandrel is established beforehand and in such established position, the tail stock is separated from the mandrel and at the same time the tail stock is retained by the retaining rod. Therefore, the tail stock can secure a correct position with respect to this mandrel as long as the mandrel is being stopped in the above-mentioned state.

Accordingly, if this spin molding apparatus is used, the tail stock can be positioned with respect to the mandrel with ease. As a consequence, the mounting work of the raw material to be molded in the spin molding can be extensively simplified compared with the prior art.

Figure 21:
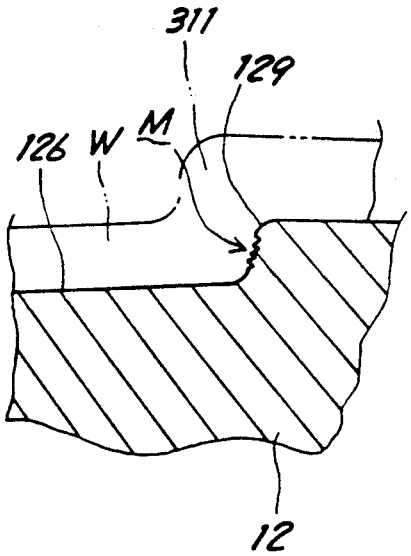
FIG. 21 is an enlarged view of the portion shown by XXI of FIG. 20.
Figure 22:
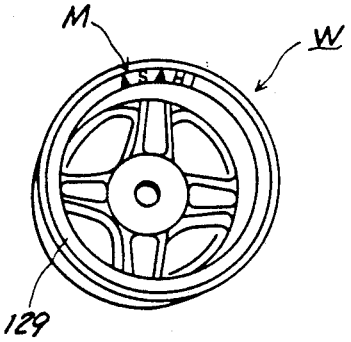
FIG. 22 is a perspective view of the molded vehicle wheel.
Figure 23:
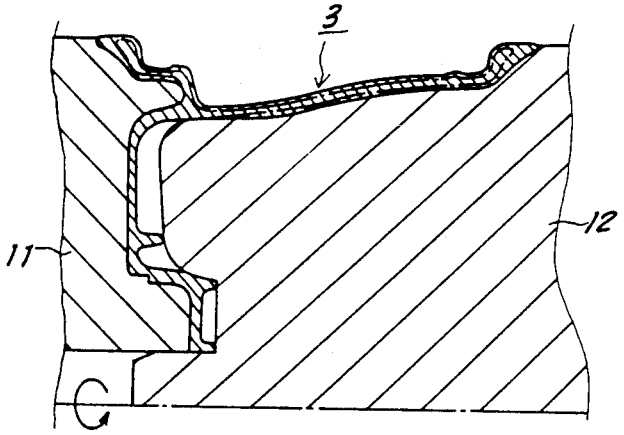
Fig. 23 PRIOR ART
FIGS. 23 and 24 are sectional views of the prior art.
Figure 24:
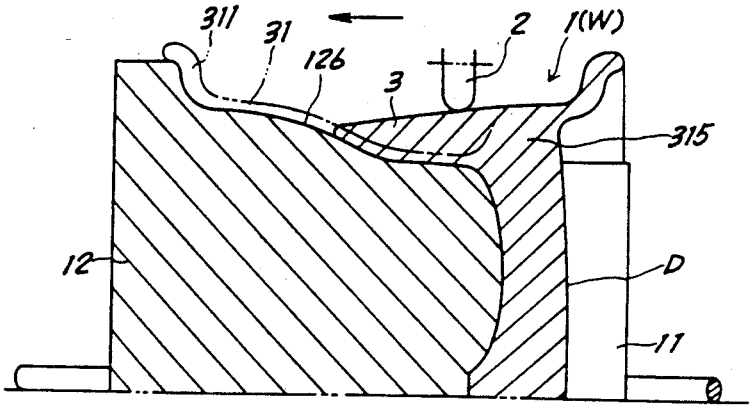
Fig. 24 PRIOR ART

Next, an embodiment will be described with reference to FIGS. 20 through 22.

Figure 20:
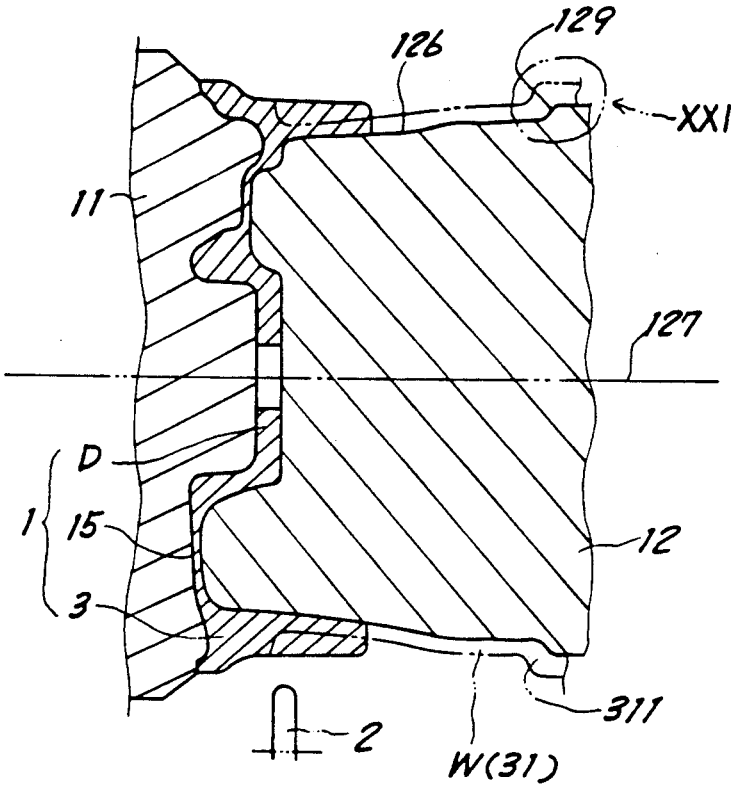
FIG. 20 is a sectional view of an alternative embodiment.

In FIG. 20, a spin molding mandrel 12 is rotatable about the axis 127 thereof. The numeral 1 denotes a wheel raw material blank which is clamped by the tail stock 11 in the state where the wheel raw material 1 is engaged with the outer periphery of the mandrel 12. This wheel raw material 1 comprises a disk portion D, a spoke portion 15, and a rim portion 3. Next, a molding surface 126 of the mandrel 12 is formed on the peripheral surface of the mandrel 12. This molding surface 126 is adapted to mold the rim portion 31 of the vehicle wheel W. Also, a rim flange molding portion 129 is formed on both edges of the mandrel 12. This rim flange molding portion 129 forms a plane generally vertical to the axis 127 of the mandrel 12. This rim flange molding portion 129, as shown in FIG. 21, is provided with irregularity displaying portion M formed thereon. This irregularity displaying portion M is formed in accordance with the shapes of letters, marks, etc. that have shapes corresponding to, for example, size of a product, manufacturing date, etc.

In the foregoing state, while rotating the mandrel 12 about the axis 127, the pressing device 2 contacts the rim raw material portion 3 and the rim raw material portion 3 is drawn outward (arrow direction by this pressing device 2. As a result, there can be spin molded a vehicle wheel (in the state shown by the imaginary line of FIG. 20) W. At this time, the size of a product, manufacturing date, etc. can be applied to the rim flange portion 311 of the vehicle wheel W simultaneously (see FIG. 22).

As the spin molding apparatus is constructed in the manner as described in the foregoing, a suitable displaying means can be applied to the molded product while molding the raw material to be molded along the molding surface of the mandrel.

Accordingly, if this spin molding apparatus is used, there is no longer a need to apply a suitable displaying means by stamping, etc., after spin molding as in the prior art. As a consequence, the work for applying such suitable displaying means to the spin molded product can be effected by one process. As a result, the working efficiency of the spin molding work is improved.

While particular embodiments of the present invention have been shown in the drawings and described above in great detail, it will be apparent that many changes and modifications can be made within the spirit of the invention. In consideration thereof, it should be understood that the preferred embodiment of the present invention disclosed herein are intended to be illustrative only and not intended to limit the scope of the invention.

What is claimed is:

1. A process for manufacturing a vehicle wheel comprising the steps:

preparing a wheel blank having raw material for a rim integrally formed at the periphery of a central disc member;

spinning said wheel blank about the axis of said disc member;

spin forming said raw material for a rim into a rim portion having two axially separate flange portions with an axial rim portion being located between said flange portions;

spin forming said axial rim portion to final thickness while leaving each said flange portion thicker than the intended respective final thickness;

heat treating said partially completed vehicle wheel after said spin forming steps; and machining by cutting means each said flange to its respective final thickness.

* * * * *